US008590259B2

(12) United States Patent
Trinko et al.

(10) Patent No.: US 8,590,259 B2
(45) Date of Patent: Nov. 26, 2013

(54) METHOD OF STRAIGHTENING FOUNDATIONAL WALLS

(76) Inventors: Thomas Trinko, Menasha, WI (US); Jason Strebe, Seymour, WI (US); Robert Brugger, Black Creek, WI (US)

( * ) Notice: Subject to any disclaimer, the term of this patent is extended or adjusted under 35 U.S.C. 154(b) by 0 days.

(21) Appl. No.: 13/396,409

(22) Filed: Feb. 14, 2012

(65) Prior Publication Data

US 2012/0204512 A1 Aug. 16, 2012

Related U.S. Application Data

(60) Provisional application No. 61/442,374, filed on Feb. 14, 2011.

(51) Int. Cl.
*E04B 1/00* (2006.01)

(52) U.S. Cl.
USPC ..... 52/741.15; 52/127.2; 405/230

(58) Field of Classification Search
USPC ..... 52/127.1, 127.2, 127.3, 127.7, 741.11, 52/741.13, 741.14, 741.15; 405/229, 230; 403/196, 218, 233, 385, 388–391, 395, 403/396, 400
See application file for complete search history.

(56) References Cited

U.S. PATENT DOCUMENTS

| | | | | | |
|---|---|---|---|---|---|
| 3,362,168 | A * | 1/1968 | Dotlich | 405/283 |
| 3,817,006 | A * | 6/1974 | Williams | 52/127.2 |
| 3,902,326 | A * | 9/1975 | Langenbach, Jr. | 405/230 |
| 4,068,427 | A * | 1/1978 | Camardo | 52/127.2 |
| 5,492,437 | A * | 2/1996 | Ortiz | 405/230 |
| 5,829,220 | A * | 11/1998 | Zumeta | 52/741.13 |
| 6,065,254 | A * | 5/2000 | Lanka | 52/127.2 |
| 6,247,273 | B1 * | 6/2001 | Nickel | 52/127.2 |
| 6,269,606 | B1 * | 8/2001 | McCown | 52/741.13 |
| 6,539,677 | B1 * | 4/2003 | Lanka | 52/127.2 |
| 7,040,059 | B2 * | 5/2006 | Hodsdon et al. | 52/127.2 |
| 7,278,802 | B2 * | 10/2007 | Bisson et al. | 405/230 |
| 2012/0023840 | A1 * | 2/2012 | Yuan | 52/122.1 |

* cited by examiner

*Primary Examiner* — William Gilbert
*Assistant Examiner* — Gisele Ford
(74) *Attorney, Agent, or Firm* — Boyle Fredrickson, S.C.

(57) ABSTRACT

A wall straightening apparatus provides multiple independently controllable jacking members pressing outward on diagonal braces to push those braces against the wall to move the wall into a vertical alignment. Feedback control of the jacking members provides coordinated straightening of large wall sections with lessened cracking and distortion.

17 Claims, 3 Drawing Sheets

METHOD OF STRAIGHTENING FOUNDATIONAL WALLS

CROSS-REFERENCE TO RELATED APPLICATIONS

This application claims the benefit of U.S. provisional patent application 61/442,374 filed Feb. 14, 2011 and hereby incorporated by reference.

FIELD OF THE INVENTION

The present invention relates to a method of straightening a foundational wall and in particular for use in the repair and reinforcement of basement walls comprised of blocks or other materials.

BACKGROUND OF THE INVENTION

Below ground walls, such as those which provide for the walls of the basement, must be able to support the weight of a structure resting thereon and to resist lateral forces associated with the surrounding soil and hydrostatic pressure from water in the soil.

Particularly when a basement wall is constructed of masonry block, lateral pressure may cause the wall to deflect inwardly and cracks to appear on the inner surface of the wall as mortar joints yield to a tensile force component. If such deflection continues unabated, the entire wall may buckle and collapse with damage to the supporting structure.

A number of methods of straightening walls experiencing initial stages of deflection employ applying a counterbalancing force on the inner surface of the basement wall by means of cables or a threaded rod passing from a plate on the inner surface of the basement wall through the wall and anchored at a position outside the wall, for example, in a trench. Tightening the cable or threaded rod may then pull the wall back into alignment. A system of this type is taught by U.S. Pat. No. 4,189,891.

In a different approach, U.S. Pat. No. 4,353,194 teaches applying force by means of an ellis jack braced between the floor of the basement and the wall suffering from deflection.

SUMMARY OF THE INVENTION

The present invention provides an improved method of straightening walls that coordinates multiple jacks simultaneously with monitoring of the wall alignment during the jacking operation. In this way, a faster and more uniform straightening process may be obtained, the latter minimizing wall damage. Further, the wall may be straightened substantially immediately, and not over a lengthy period of time as required of other more gradual processes.

Other features and advantages of the invention will become apparent to those skilled in the art upon review of the following detailed description, claims and drawings in which like numerals are used to designate like features.

Figure 1:
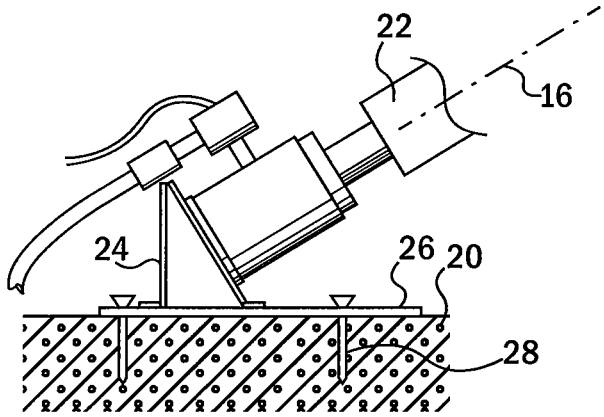
FIG. 1 is a side elevational view of a hydraulic jack mounted on a fixture for attachment to a concrete slab basement floor in one embodiment of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a hydraulic cylinder 10 of the type known in the art may receive hydraulic fluid through electronically controllable valve 12 from hydraulic hose 14. As is understood in the art, hydraulic cylinders provide for an enclosed chamber that may be pressurized with a hydraulic fluid to apply force to a shaft communicating with the enclosed chamber through a piston or the like.

The hydraulic cylinder 10 may provide for a piston driven shaft 15 having a portion extending from an end of the hydraulic cylinder 10 along an axis 16 tipped at approximately 45 degrees with respect to a plane of the floor 20 on which the hydraulic cylinder 10 rests. The end of the shaft 15 may connect with one end of a diagonal brace 22 also extending along the axis 16.

A base of a hydraulic cylinder 10 may be attached to and supported by a bracket 24 orienting the shaft 15 along axis 16, for example, the bracket 24 being fabricated of welded steel plate having a base plate 26 that may rest against the floor 20 with holes receiving anchor screws 28 or the like therethrough to anchor the bracket 24 to the floor 20. The bracket 24 further provides an angled steel plate against which the base of the hydraulic cylinder 10 may rest so that the piston driven shaft 15 extends along the axis 16. In an alternative embodiment, (not shown) the bracket 24 may provide a hinge plate allowing flexible adjustment of the angle of the base of the hydraulic cylinder 10 as required.

Figure 2:
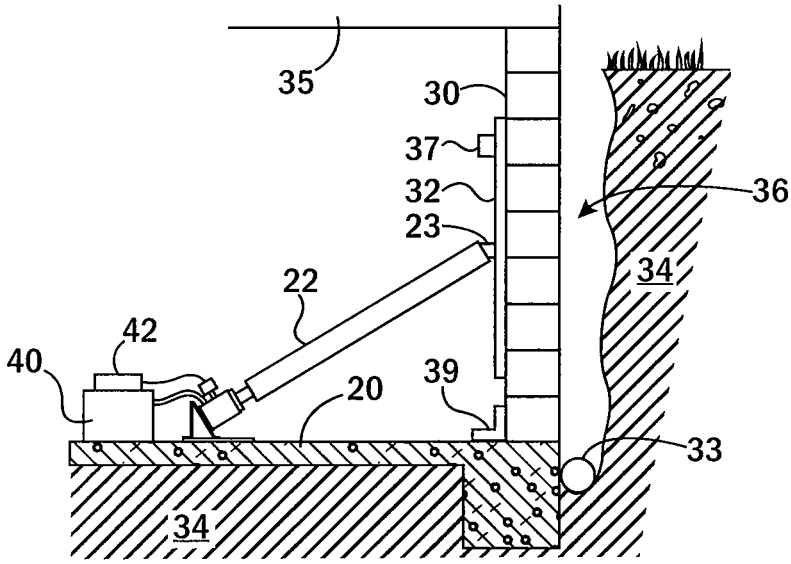
FIG. 2 is a side elevational view of the hydraulic jack of claim 1 positioned with a bracing system against a foundational wall shown in cross-section.

Referring now to FIG. 2, the diagonal brace 22 may extend toward a basement wall 30 and be aligned to abut at a hinge 23 an upright brace 32 between the ends of the upright brace 32. The upright brace 32 may fit against an inner surface of the wall 30 extending approximately vertically by about four feet so that pressure can be directed to a specific spot on the wall 30. The position of the upright brace 32 is moved up or down the wall 30 depending on where the deflection is. For example, if the wall 30 is bowed at the center then that is where the center of the upright brace is located, if the wall 30 is tipped but essentially flat, then the upright brace is put as high as possible. In the case of severely bowed walls, this fitting against the inner surface may only contact portions of the inner surface. The lower end of the upright brace 32 will generally be above the floor 20. The diagonal brace 22 and the upright brace 32 may be, for example, rectangular steel pipes or other steel shape including angles, tubes, or I-beams . . . .

Figure 7:
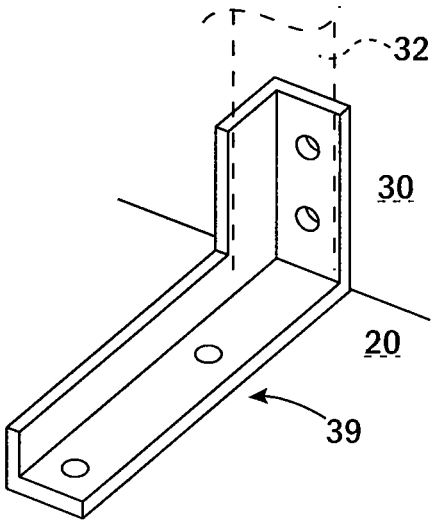
FIG. 7 is a perspective view of a foot bracket used to prevent push-out of the basement wall near the floor.

Referring now to FIG. 7, the foot bracket 39 may provide for an L-shaped bracket having a first face that may be attached to the floor 20 with anchor bolts and a second face extending vertically therefrom adjacent to the wall 30 to be anchored thereto. The foot bracket 39 prevents the base of the wall 30 from separating from the floor 20 and moving outward as the wall 30 is straightened. A similar top bracket may be used when it is desired to prevent movement of the top of the wall 30 with respect to the house joists.

Soil 34 outside of the wall 30 may be excavated to provide for a trench 36 on the outside of the wall 30 allowing the wall 30 to be pushed outward into alignment. This trenching operation may be used to replace a drain 33 placed at the bottom of the trench 36.

A tilt sensor 37 may be attached to the top of the upright brace 32 (or other convenient location) to provide an indication of whether the brace 32 is level and/or to detect movement or acceleration of the top of the upright brace 32. Typically before the straightening process, the brace 32 will not be vertical but will lean toward the cylinder 10 caused by inward deflection of the wall 30.

Figure 3:
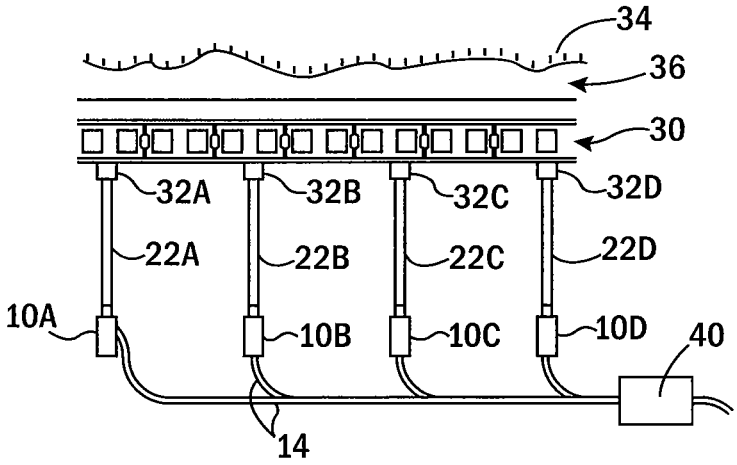
FIG. 3 is a top plan view of multiple braces of FIG. 2, each with a hydraulic jack.

Referring now to FIG. 3, multiple brace systems comprised each of a cylinder 10, a diagonal brace 22, and an upright brace 32 (here shown as cylinders 10*a-d*, diagonal braces 22*a-d*, and upright braces 32*a-d*) may be simultaneously applied against the wall 30 with the cylinders 10*a-d* connected to a common hydraulic pressure source 40, for example an electric pump.

Figure 4:
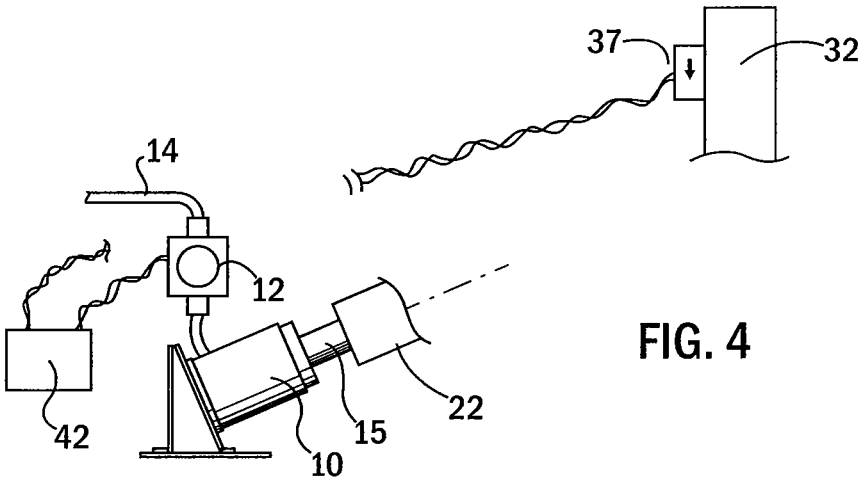
FIG. 4 is a fragmentary elevational view showing the interconnection of an electronic level-sensor to a control valve of the hydraulic cylinder of FIG. 1.

Referring now to FIG. 4, in a first embodiment, an electronic control system 42, for example a microcontroller or programmable logic controller, may receive a signal from tilt sensor 37, for example a mercury switch, a pendulum and angle sensor (for example a potentiometer) combination, or a solid-state accelerometer, providing an indication of the vertical orientation of the upright brace 32. In the case of the accelerometer, an angular deviation of a gravitational vector from the axis of the upright brace 32 may be determined as well as acceleration of the top of the upright brace 32. It will further be appreciated that the indication of vertical orientation of the upright brace may be detected by measuring displacement of the shaft 15 (using a displacement sensor) and trigonometric formulae, for example using known positioning of the bracket 24 with respect to a base of the wall and the height of the hinge 23.

The electronic control system 42 also provides electrical signals controlling valves 12, one for each cylinder 10*a-d*. Generally, during operation, the electronic control system 42 may, in a first embodiment, allow all valves 12 to be open and the cylinders 10*a-d* to extend their shafts 15 outward to press upward on the brace 22 straightening the wall until a signal from the tilt sensor 37 of any upright brace 32 indicates that the upright brace 32 is vertical at which time the electronic control system 42 may shut the valve 12 associated with that upright brace 32 only. In this way each of the brace systems of FIG. 3 may operate simultaneously to bring the wall back into alignment.

Figure 6:
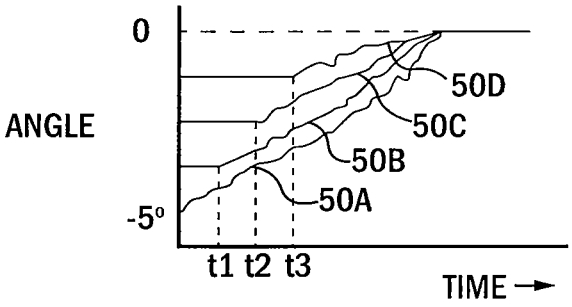
FIG. 6 is a plot of data that may be sensed by the level-sensor of FIG. 4 to control hydraulic fluid gated to the cylinders to minimize wall damage.

Referring now to FIG. 6, the ability to monitor the orientation of the braces 32 permits more sophisticated control strategies where a most out of alignment section of the wall 30, indicated by signal 50*a* from a tilt sensor 37, is moved first during time terminating at $t_1$ and the other sections of the walls indicated by signals 50*b-c* from corresponding tilt sensors 37 are moved only after time $t_1$ is passed. Upon completion of time $t_1$, the other sections of the wall may be moved, for example the upright brace 32 associated with signal 50*b* being moved after time $t_1$, and the upright brace 32 associated with signal 50*c* being moved after time $t_2$ is complete, and the upright brace 32 associated with signal 50*d* being moved after time $t_3$ is complete. Using this technique, the amount of distortion of the wall 30 during this alignment may be significantly reduced thereby reducing additional damage from the alignment process.

Another possible control strategy moves the upright braces 32 at substantially constant angular rates that are different in proportion to the misalignment of the wall associated with that upward brace so that all upward braces move to reach alignment with vertical at substantially the same time.

It will be appreciated that even more sophisticated control algorithms may be developed that look at acceleration to control the valves 12 to reduce or warn of sudden acceleration, or that detect overcenter travel where the wall moves beyond vertical to provide warnings of this situation, or that monitor pressure differentials using pressure gauges (not shown) on each hydraulic hose 14.

Figure 5:
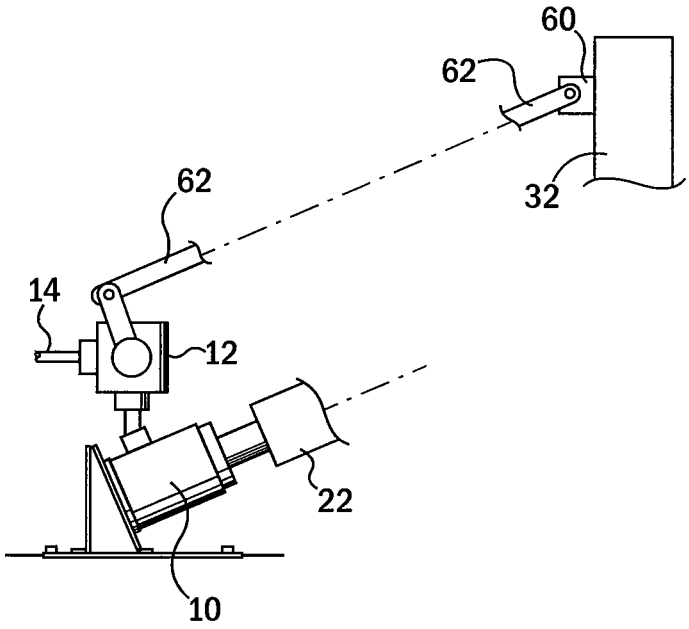
FIG. 5 is a figure similar to that of FIG. 4 showing an alternative mechanical implementation of the present invention.

Referring now to FIG. 5, the present invention contemplates that the sensing of the orientation of the upright braces 32 may be performed mechanically, for example, by attaching a pivot point 60 to the upper end of the upright brace 32 communicating via tie arm 62 to a lever-operated valve 12' with a turnbuckle or other length adjusting mechanism used to cause movement of the upright brace 32 to shut off the valve 12 when the upright brace 32 is in the vertical position. In this case, the tie arm 62 provides a tilt sensor based on a known geometry of the system.

It will also be appreciated that the hydraulic cylinders may be replaced with, for example, electric screw jacks or the like. Further, it will be understood that the present invention is applicable to a wide variety of different types of walls beyond the block walls depicted but also including poured walls.

Certain terminology is used herein for purposes of reference only, and thus is not intended to be limiting. For example, terms such as "upper", "lower", "above", and "below" refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence, or order unless clearly indicated by the context.

References to an electronic control system can be understood to include one or more processors that can communicate in a stand-alone and/or a distributed environment(s), and can thus be configured to communicate via wired or wireless communications with other processors, where such one or more processor can be configured to operate on one or more processor-controlled devices that can be similar or different devices.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A method for straightening a wall which extends below the ground comprising the steps of:

placing a set of upright braces against an inner surface of the wall;

affixing a corresponding set of jacking members against a floor spaced from the inner surface of the wall;

attaching a diagonal brace between the jacking members and the upright braces so that extension of the jacking members pushes outward on upright braces against the inner surface of the wall; and automatically sensing a position of the upright braces to independently control the jacking members;

wherein the jacking members are hydraulic cylinders controlled by hydraulic valves wherein the automatic sensing of the position of the upright braces is accomplished by a linkage between an upright brace and a hydraulic valve associated with a hydraulic cylinder acting on the upright brace.

2. A method for straightening a wall which extends below the ground comprising the steps of:

placing a set of upright braces against an inner surface of the wall;

affixing a corresponding set of jacking members against a floor spaced from the inner surface of the wall;

attaching a diagonal brace between the jacking members and the upright braces so that extension of the jacking members pushes outward on upright braces against the inner surface of the wall; and automatically sensing a position of the upright braces to independently control the jacking members wherein the jacking members are electric jack screws controllable by a motor signal.

3. A method for straightening a wall which extends below the ground comprising the steps of:

placing a set of upright braces against an inner surface of the wall;

affixing a corresponding set of jacking members against a floor spaced from the inner surface of the wall;

attaching a diagonal brace between the jacking members and the upright braces so that extension of the jacking members pushes outward on upright braces against the inner surface of the wall; and automatically sensing a position of the upright braces to independently control the jacking members wherein the control of the jacking members is to stop the jacking member when an upright brace associated with the jacking member is substantially vertical.

4. The method of claim 3 wherein the sensing of the position of the upright braces is accomplished by electronic sensors attached to move with the upright braces.

5. The method of claim 4 wherein the electronic sensors are selected from the group consisting of a mercury electrical switch, a solid-state electronic accelerometer, a pendulum and electronic angle sensor combination, and a displacement sensor measuring displacement of the jacking member.

6. The method of claim 3 further including the step of positioning a set of foot brackets at a foot of the wall against the wall and floor to hold the wall and floor against separation and movement.

7. A method for straightening a wall which extends below the ground comprising the steps of:

placing a set of upright braces against an inner surface of the wall;

affixing a corresponding set of jacking members against a floor spaced from the inner surface of the wall;

attaching a diagonal brace between the jacking members and the upright braces so that extension of the jacking members pushes outward on upright braces against the inner surface of the wall; and automatically sensing a position of the upright braces to independently control the jacking members wherein the control of the jacking members is to first move jacking members associated with initial upright braces that are most out of alignment with vertical and then to move jacking members associated with subsequent upright braces that are less out of alignment with vertical as moving initial upright braces align with the subsequent upright braces.

8. A method for straightening a wall which extends below the ground comprising the steps of:

placing a set of upright braces against an inner surface of the wall;

affixing a corresponding set of jacking members against a floor spaced from the inner surface of the wall;

attaching a diagonal brace between the jacking members and the upright braces so that extension of the jacking members pushes outward on upright braces against the inner surface of the wall; and automatically sensing a position of the upright to independently control the jacking members wherein the control of the jacking members is to move the jacking members at different substantially constant rates to promote vertical alignment of the upright braces simultaneously.

9. An apparatus for straightening a wall which extends below the ground comprising:

a set of upright braces positionable against an inner surface of the wall;

a corresponding set of jacking members positionable against a floor spaced from the inner surface of the wall;

a corresponding set of diagonal braces having attachment elements for attaching the diagonal braces between the jacking members and the upright braces so that extension of the jacking members pushes outward on upright braces against the inner surface of the wall; and a feedback controller automatically sensing the position of the upright braces to independently control the jacking members;

wherein the jacking members are hydraulic cylinders controlled by hydraulic valves including a linkage between an upright brace and a hydraulic valve associated with a hydraulic cylinder acting on the upright brace, the linkage providing an automatic sensing of the position of the upright brace.

10. An apparatus for straightening a wall which extends below the ground comprising:

a set of upright braces positionable against an inner surface of the wall;

a corresponding set of jacking members positionable against a floor spaced from the inner surface of the wall;

a corresponding set of diagonal braces having attachment elements for attaching the diagonal braces between the jacking members and the upright braces so that extension of the jacking members pushes outward on upright braces against the inner surface of the wall; and a feedback controller automatically sensing the position of the upright braces to independently control the jacking members wherein the jacking members are electric jack screws controllable by a motor signal.

11. An apparatus for straightening a wall which extends below the around comprising:

a set of upright braces positionable against an inner surface of the wall;

a corresponding set of jacking members positionable against a floor spaced from the inner surface of the wall;

a corresponding set of diagonal braces having attachment elements for attaching the diagonal braces between the jacking members and the upright braces so that extension of the jacking members pushes outward on upright braces against the inner surface of the wall; and a feedback controller automatically sensing the position of the upright braces to independently control the jacking members wherein the feedback controller operates to stop the jacking member when an upright brace associated with the jacking member is substantially vertical.

12. The apparatus of claim 11 further including an electronic sensor attached to move with the vertical members to provide electronic signals to the electronic controller indicating positioning of the upright braces.

13. The apparatus of claim 12 wherein the electronic sensors are selected from the group consisting of a mercury electrical switch, a solid-state electronic accelerometer, a pendulum and electronic angle sensor combination, and a displacement sensor measuring displacement of the jacking member.

14. The apparatus of claim 11 wherein the jacking members are hydraulic cylinders controlled by hydraulic valves.

15. The apparatus of claim 11 further including a set of foot brackets at the foot of the wall positionable against the wall and floor to hold the wall and floor together during the straightening process.

16. An apparatus for straightening a wall which extends below the ground comprising:

a set of upright braces positionable against an inner surface of the wall;

a corresponding set of jacking members positionable against a floor spaced from the inner surface of the wall;

a corresponding set of diagonal braces having attachment elements for attaching the diagonal braces between the jacking members and the upright braces so that extension of the jacking members pushes outward on upright braces against the inner surface of the wall; and a feedback controller automatically sensing the position of the upright braces to independently control the jacking members wherein the feedback controller is an electronic computer controlling the jacking members to first move jacking members associated with initial upright braces that are most out of alignment with vertical and then to move jacking members associated with subsequent upright braces that are less out of alignment with vertical when moving initial upright braces align with the subsequent upright braces.

17. An apparatus for straightening a wall which extends below the ground comprising:

a set of upright braces positionable against an inner surface of the wall;

a corresponding set of jacking members positionable against a floor spaced from the inner surface of the wall;

a corresponding set of diagonal braces having attachment elements for attaching the diagonal braces between the jacking members and the upright braces so that extension of the jacking members pushes outward on upright braces against the inner surface of the wall; and a feedback controller automatically sensing the position of the upright braces to independently control the jacking members wherein the feedback controller is an electronic computer controlling the jacking members to move the jacking members at different substantially constant rates to promote vertical alignment of the upright braces simultaneously.

* * * * *